US010271607B2

(12) United States Patent
Hickey

(10) Patent No.: US 10,271,607 B2
(45) **Date of Patent: *Apr. 30, 2019**

(54) CAP WITH A CONFIGURABLE SECUREMENT MECHANISM

(71) Applicant: Jimmy Hickey, Portland, OR (US)

(72) Inventor: Jimmy Hickey, Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/420,079

(22) Filed: Jan. 30, 2017

(65) Prior Publication Data

US 2017/0202294 A1 Jul. 20, 2017

Related U.S. Application Data

(63) Continuation of application No. 14/751,608, filed on Jun. 26, 2015, now Pat. No. 9,554,612.

(60) Provisional application No. 62/078,301, filed on Nov. 11, 2014.

(51) Int. Cl.

| | |
|---|---|
| ***A42B 7/00*** | (2006.01) |
| ***A42B 1/06*** | (2006.01) |
| ***A42B 1/22*** | (2006.01) |

(52) U.S. Cl.

CPC ..... *A42B 7/00* (2013.01); *A42B 1/062* (2013.01); *A42B 1/22* (2013.01)

(58) Field of Classification Search

CPC ..... A42B 7/00; A42B 1/062; A42B 1/22
USPC ..... 2/171.4, 175.6, 0.7, 183, 195.1–195.4
See application file for complete search history.

(56) References Cited

U.S. PATENT DOCUMENTS

| | | | | |
|---|---|---|---|---|
| 2,698,434 A | | 1/1955 | Davia | |
| 4,608,721 A | | 9/1986 | Lipkin | |
| 4,628,543 A | | 12/1986 | Hunt | |
| 4,829,600 A | | 5/1989 | Courtney | |
| 5,144,695 A | * | 9/1992 | Schweizer | A42B 3/08 2/175.6 |
| 5,240,123 A | | 8/1993 | Hawk | |
| 5,343,567 A | | 9/1994 | Zumbiel | |
| 5,437,062 A | | 8/1995 | Douglas | |
| 5,450,629 A | * | 9/1995 | Gilstrap | A42B 1/062 2/10 |
| 5,509,144 A | | 4/1996 | Soergel et al. | |
| 5,533,213 A | | 7/1996 | Reiner et al. | |
| 5,647,064 A | | 7/1997 | Whittaker | |
| 5,685,465 A | | 11/1997 | Berardis | |
| 5,741,060 A | | 4/1998 | Johnson | |
| 5,799,334 A | | 9/1998 | Griffith et al. | |
| 5,884,335 A | | 3/1999 | Whittaker | |
| 5,920,913 A | | 7/1999 | Brandon et al. | |

(Continued)

*Primary Examiner* — Katherine M Moran
(74) *Attorney, Agent, or Firm* — Chernoff, Vilhauer, McClung & Stenzel, LLP

(57) ABSTRACT

A cap includes a crown portion being generally hemispherical in shape and having a hollow interior such that the crown portion defines an interior surface and an exterior surface and the crown portion further includes an apex and a generally circular base. A securement mechanism includes a first and a second elongate flexible strand where each of the flexible strands have a first, a second end, and a mid portion. A bead defines a pair of openings there through where a first end of the first flexible strand extends through a first one of the pair of openings and a first end of the second flexible strand extends through a second one of the pair of openings. The cap retains the second end of each of the flexible strands on opposing sides of the cap.

7 Claims, 4 Drawing Sheets

(56) References Cited

U.S. PATENT DOCUMENTS

| | | | | |
|---|---|---|---|---|
| 5,926,849 | A | 7/1999 | Boyle | |
| D419,751 | S | 2/2000 | Hicks | |
| D423,196 | S | 4/2000 | White | |
| 6,044,495 | A | 4/2000 | Ellman et al. | |
| 6,125,997 | A | 10/2000 | Campbell | |
| 6,237,156 | B1 | 5/2001 | Ellman et al. | |
| 6,347,410 | B1 | 2/2002 | Lee | |
| 6,349,415 | B1 | 2/2002 | Gong | |
| 6,442,762 | B1 * | 9/2002 | Neumann | A42B 7/00 132/58 |
| RE38,394 | E | 1/2004 | Morse et al. | |
| 6,704,044 | B1 | 3/2004 | Foster et al. | |
| D488,293 | S | 4/2004 | Norway, Jr. | |
| 6,966,071 | B1 | 11/2005 | Cascone | |
| D539,012 | S | 3/2007 | Evans | |
| 7,278,173 | B2 | 10/2007 | Turner | |
| D605,852 | S | 12/2009 | Yusufov et al. | |
| 8,020,218 | B2 | 9/2011 | Stingone | |
| D660,555 | S | 5/2012 | Stoltz | |
| 9,554,612 | B2 * | 1/2017 | Hickey | A42B 7/00 |
| 2007/0022514 | A1 | 2/2007 | Paulson | |
| 2007/0064413 | A1 | 3/2007 | Slater | |
| 2007/0256213 | A1 | 11/2007 | Dunavin | |
| 2007/0283482 | A1 | 12/2007 | Lawrence | |
| 2008/0034475 | A1 | 2/2008 | Boord | |
| 2010/0138980 | A1 | 6/2010 | Duda et al. | |
| 2010/0287685 | A1 | 11/2010 | Peterson et al. | |
| 2011/0041238 | A1 | 2/2011 | Brzoska | |
| 2012/0096625 | A1 | 4/2012 | Sarazin | |
| 2012/0182726 | A1 | 7/2012 | King | |
| 2013/0007944 | A1 | 1/2013 | Touray | |
| 2014/0020153 | A1 | 1/2014 | Romanski et al. | |
| 2015/0026867 | A1 | 1/2015 | Brzoska | |

* cited by examiner

CAP WITH A CONFIGURABLE SECUREMENT MECHANISM

This application is a continuation of U.S. patent application Ser. No. 14/751,608, filed Jun. 26, 2015, which application claims the benefit of U.S. Provisional Patent App. No. 62/078,301, filed Nov. 11, 2014.

BACKGROUND OF THE INVENTION

The present invention relates generally to configurable caps.

Caps come in different shapes and styles with a variety of different intended uses and with the wearer's sense of fashion. Although the principal purpose of a cap is to protect the wearer's head from the elements and shield the wearer's eyes from the glare of the sun, often the caps are provided with no effective manner of retaining the cap on the wearer's head and storing the retaining mechanism on the cap. For those engaged in vigorous activities, such as walking, biking, golfing, snowboarding, auto racing, skiing, it is desirable that the cap does not readily become detached from the wearer's head. While chin straps exist for caps, and especially baseball caps, they tend to be difficult to use and difficult to maintain in a desirable configuration when not in use as a chin strap.

BRIEF DESCRIPTION OF THE DRAWINGS

FIG. 3 illustrates the head of FIG. 2 with the pair of strands extending there through.

DETAILED DESCRIPTION OF THE PREFERRED EMBODIMENTS

Figure 1:
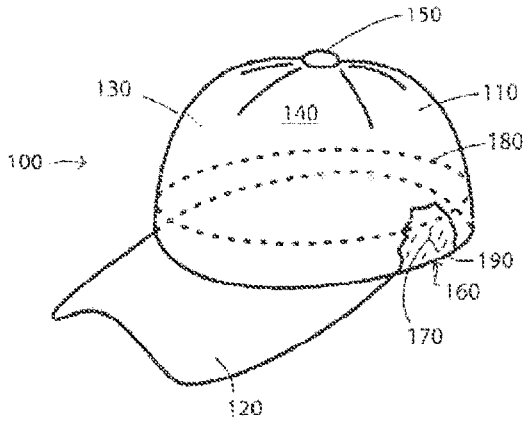
FIG. 1 illustrates a cap with a visor.

In general, a cap 100 is fabricated having a crown 110 and a visor 120, where the crown 110 is generally hemispherical in shape. The crown 110 has a hollow interior, this hollow interior being the portion of the cap which fits about the upper portion of the head of the wearer. The crown 110 has an interior surface 130 and an exterior surface 140, which is provided with an apex 150 and overlies and confronts the interior surface 130 of the crown 110 adjacent to a circular base 160.

The crown 110 of the cap is also provided with an interior band 170 which results from the inward folding of the peripheral edge of the crown. The interior band 170 extends upward toward the apex 150 and overlies and confronts the interior surface 130 of the crown 110 adjacent to the circular base 160.

The interior band 170 has a terminal or free edge 180 and a fold edge 190, wherein the fold edge 190 of the interior band 170 consists of the portion of the crown 110 which corresponds to the folding of the peripheral edge of the crown 110. The exterior surface 140 of the crown 110 immediately adjacent to the fold edge 190 defines the generally circular base 160.

The interior band 170 terminates within the hollow interior of the crown 110 at a free edge 180, the free edge 180 being adjacent to but spaced apart from the fold edge 190. This spacing of the free edge 180 and the fold edge 190 defines the height of the interior band 170.

The cap 100 includes the visor 120 which extends laterally outwardly from a position of the exterior surface 140 of the generally circular base 160 of the crown 100. When the cap 100 is worn, the visor 120 is placed adjacent to the forehead of the wearer, and is intended to shield the wearer's eyes from the sun or other weather elements.

Figure 2:
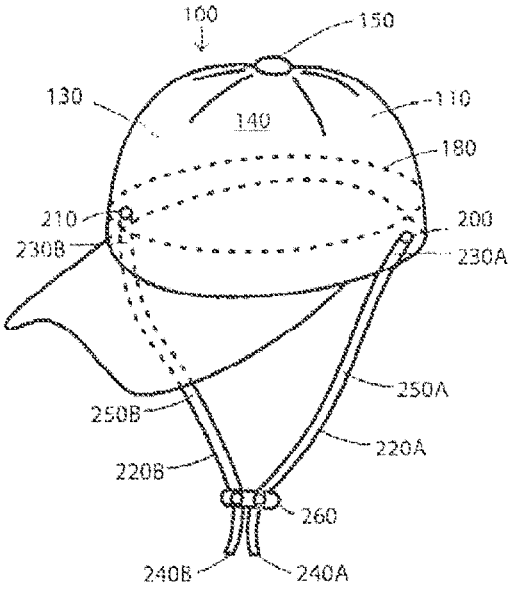
FIG. 2 illustrates the cap of FIG. 1 with a pair of strands secured to the cap and a bead in a first configuration.

Referring to FIG. 2, the cap 100 may define a pair of openings 200, 210 such as eyelets, on opposing sides of the cap 100. Typically the openings are only defined in the exterior surface 140 of the crown 110. Preferably, the openings 200, 210 are aligned with the interior band 170. Alternatively, the openings may be defined in both the exterior surface 140 of the crown 110 and the interior band 170, generally aligned with one another, to permit an opening from the exterior of the cap 100 to the interior of the cap 100 being preferably in a perpendicular direction to the exterior surface 140 of the crown 110.

Elongate flexible strands 220A and 220B have a first end 230A, 230B and a second end 240A, 240B with a mid portion 250A, 250B which extends between the first end 230A, 230B and the second end 240A, 240B. The strands 220A, 220B are preferably formed from a durable natural or synthetic twine. Other materials may likewise be used, such as plastic, leather, wire, webbing, etc. The strands preferably have a diameter of generally 2-4 mm and an approximate collective length of 15 inches. The length should be sufficient such that it permits the wearer to readily pass the strands 220A, 220B around his neck so that the cap 100 may be more readily retained on the head of the wearer. Other lengths and sizes of the strands 220A, 220B may likewise be used, as desired. The first ends 230A, 230B of the respective strands 220A, 220B preferably pass through the openings 200, 210 and the first ends 230A, 230B are secured to the cap 100. One manner of securing the first ends 230A, 230B is by including a knot in the end of the first ends 230A, 230B. Alternative securement techniques may likewise be used, as desired. The second ends 240A, 240B of the respective strands 220A, 220B are preferably extended through a bead 260.

Figure 3:
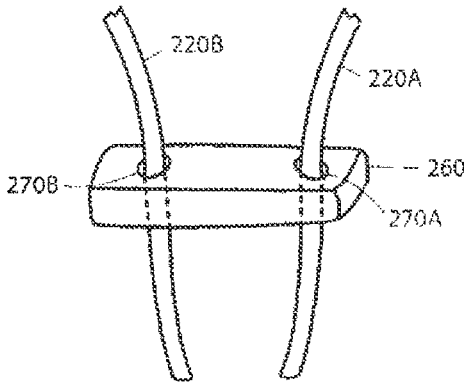

Referring to FIG. 3, the bead 260 is provided with at least two holes 270A, 270B. The respective strand 220A, 220B is extended through the respective holes 270A, 270B. The bead 260 is preferably formed from wood, but may be formed from other materials, such as for example, wood, bone, stone, glass, leather, metal, etc. The bead 260 is preferably rectangular in shape, but may be other shapes, such as for example, triangular, spherical, elliptical, irregular, etc. The exterior surface of the bead 260 is preferably smooth, but may be rough, porous, planar, irregular, etc. The bead 260 may be slid along the length of the respective strands 220A, 220B to tighten and loosen the cap 100 secured to the wearer's head, in addition to the ability to sufficiently loosen the strands so that, the cap can be readily removed from the wearers head.

Rather than removing the strands 220A, 220B from the cap 100 while the wearer does not need the strands 220A, 220B to secure the cap 100 to his head, such as during extreme sports or windy conditions, the wearer may reconfigure the strands 220A, 220B in an alternative configuration. Preferably the reconfiguration is achieved without the need to remove the strands 220A, 220B from the bead 260.

Figure 4:
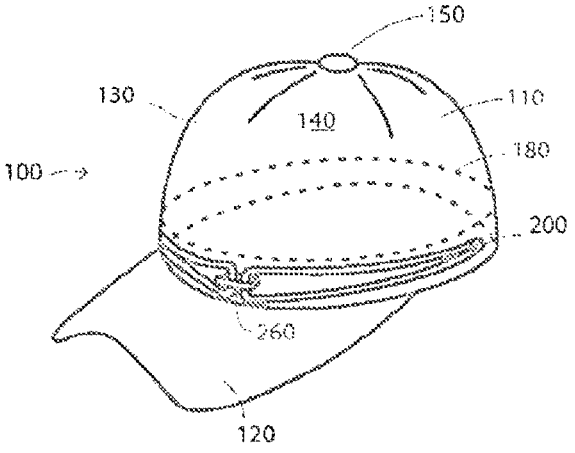
FIG. 4 illustrates the cap of FIG. 2 with the pair of strands secured to the cap and the bead in a second configuration.
Figure 5:
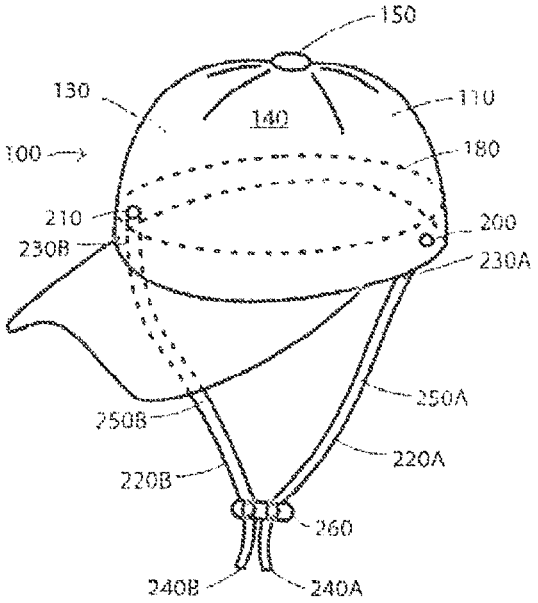
FIG. 5 illustrates an alternative embodiment of the cap shown in FIG.

Referring to FIG. 4, the strands 220A, 220B may be pulled further through the bead 260 with the bead 260 being positioned in a location above the visor 120. The bead 260 may be positioned where it is laying on top of the visor 120 or it may be positioned on the frontal portion of the cap 100 on the exterior surface thereof 140 substantially adjacent the visor 120. One end 230A, 230B of the strand 220A, 220B is secured within the respective openings 200, 210. The other end 240A, 240B is detachably secured within the respective opening 200, 210 by inserting the end therein. In this manner, both ends 230A/240A, 230B/240B are maintained within the respective openings 200, 210. The length of the frontal loop of the respective strands 220A, 220E are shortened until the bead 260 is maintained in a substantially secured position on the frontal portion of the cap 100. In this manner, the bead 260 is preferably positioned in a location where it does not substantially move when the cap 100 is worn by the wearer, while at the same time permitting the strands 220A, 220B to similarly be secured. The ends 240A, 2408 may be removed from the respectively openings 200, 210, the bead 260 slid along the length of the strands 220A, 220B, and the strands 220A, 220B positioned in an arrangement as shown in FIG. 2. This may be achieved without removing the bead 260 from either of the strands 220A,220B Referring to FIG. 5, an alternative embodiment is illustrated where the ends 230A, 230B of the strands 220A, 220B are secured to the inside surface of the cap 100, preferably at a location proximate the base 160. The securement is preferably achieved by sewing the strand to the cap 100 so that the ends 230A, 230B are not viewable while the cap 100 is worn by the wearer. The securement may also be achieved by threading the ends 230A, 230B of the strands 220A, 220B through an opening defined in the interior band 170, including a knot on the ends thereof to maintain the ends 230A, 230B from being readily removed.

Figure 6:
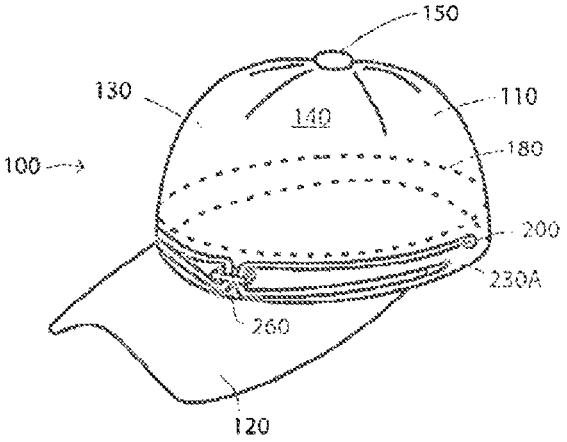
FIG. 6 illustrates an alternative embodiment of the cap shown in FIG. 4.

Referring to FIG. 6, with the bead 260 maintained at a location proximate the visor, the other ends 240A, 240B of the strands 220A, 220B may be inserted within the openings 200, 210. In this manner, the ends 240A, 240B of the strands 220A, 220B may be more readily detachably engaged with the openings 200, 210.

Figure 7:
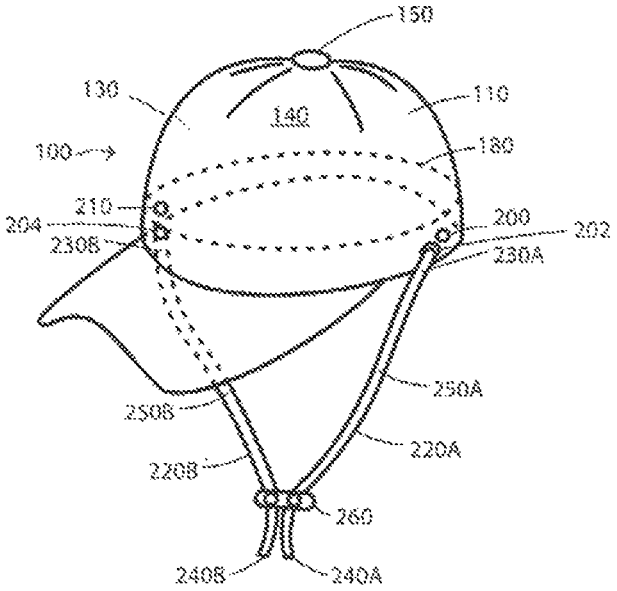
FIG. 7 illustrates a further alternative embodiment of the cap shown in FIG. 2.

Referring to FIG. 7, an alternative embodiment is illustrated where the ends 230A, 230B of the strands 220A, 220B are secured through a pair of secondary openings 202, 212 (another pair of which may be included within the interior band 170, if desired) defined in the cap 100, preferably at a location proximate the base 160. The securement is preferably achieved by positioning the ends 230A, 2308 of the strand through the secondary openings 202, 212 so that the ends thereof are not viewable while the cap 100 is worn by the wearer.

Figure 8:
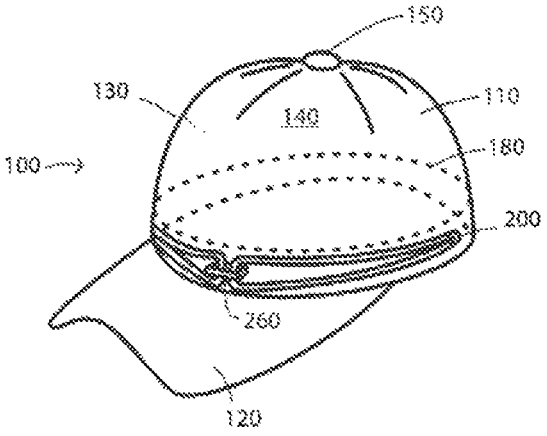
FIG. 8 illustrates a further alternative embodiment of the cap shown in FIG. 4.

Referring to FIG. 8, with the bead 260 maintained at a location proximate the visor, the other ends 240A, 240B of the strands 220A, 220B may be inserted within the openings 200, 210. In this manner, the ends 240A, 240B of the strands 220A, 220B may be more readily detachably engaged with the openings 200, 210.

It is to be understood that the claims are not limited to the precise configuration and components illustrated above. Various modifications, changes and variations may be made in the arrangement, operation and details of the systems, methods, and apparatus described herein without departing from the scope of the claims.

The invention claimed is:

1. A cap comprising:

(a) a crown portion, said crown portion being generally hemispherical in shape and having a hollow interior such that the crown portion defines an interior surface and an exterior surface, said crown portion further comprising an apex and a generally circular base;

(b) the crown portion further comprising a band, said band resulting from an inward folding of the peripheral edge of said crown portion such that said band extends toward said apex and overlies and confronts said interior surface of said crown portion proximate to said base, said band comprising a free edge and a fold edge;

(c) wherein said fold edge of said band consists of the portion of said crown portion which corresponds to said folding of the peripheral edge of the crown portion, said fold edge defining said generally circular base;

(d) wherein said band terminates within said hollow interior of said crown portion at said free edge, said free edge being adjacent to but spaced apart from said fold edge such that said band has a height;

(e) wherein a securement mechanism comprises a first and a second elongate flexible strand; said first flexible strand having a first end, a second end, and a mid portion which extends between said first end and said second end; and said second flexible strand having a first end, a second end, and a mid portion which extends between said first end and said second end;

(f) a slidable member that defines a pair of openings there through where a first end of said first flexible strand extends through a first one of said pair of openings defined by said slidable member and a first end of said second flexible strand extends through a second one of said pair of openings defined by said slidable member, where said slidable member is slidably engaged with said first flexible strand and said second flexible strand;

(g) said cap retaining said second end of said first flexible strand on a first side thereof of said cap, said cap retaining said second end of said second flexible strand on a second side thereof of said cap, where said first side and said second side are on opposing sides of a visor attached to said cap;

(h) said cap retaining said first end of said first flexible strand on said first side thereof of said cap, said cap retaining said second end of said second flexible strand on said second side thereof of said cap, where said slidable member is retained in a location above said visor and in substantially pressing engagement with at least one of said visor and said exterior surface of said crown portion;

(i) wherein said second end of said first flexible strand and said second end of said second flexible strand is each said retained and attached in a manner that said second end of said first flexible strand and said second end of said second flexible strand is not readily detachable from said cap;

(j) wherein said first end of said second flexible strand and said first end of said second flexible strand is each said retained in a manner that said first end of said first flexible strand and said first end of said second flexible strand is readily movable away from said cap;

(k) wherein said first flexible strand and said second flexible strand each said extends through said slidable member such that a respective mid portion of said respective first flexible strand and said second flexible strand resides within said slidable member;

(l) wherein said second end of said first flexible strand is retained by a first eyelet of said cap and said second end of said second flexible strand is retained by a second eyelet of said cap.

2. The cap of claim 1 wherein said slidable member is retained in a first position being a face to face engagement with said exterior surface of said crown portion.

3. The cap of claim 2 wherein said first end of said first flexible strand is retained by said first eyelet of said cap and said first end of said second flexible strand is retained by said second eyelet of said cap.

4. The cap of claim 3 wherein said slidable member is retainable in a second position being a location hanging below said crown portion by movement of said slidable member from said first position to said second position.

5. The cap of claim 4 wherein when said slidable member is retainable in said second position with said first flexible strand not being retained by said first eyelet of said cap by movement of said first flexible strand and said first end of said second flexible strand not being retained by said second eyelet of said cap by movement of said second flexible strand.

6. The cap of claim 5 wherein when said slidable member is retained in said second position with said first flexible strand freely hangs below said cap by movement of said first flexible strand and said first end of said second flexible strand freely hangs below said cap by movement of said second flexible strand.

7. The cap of claim 6 wherein said first and second position of said slidable member is achievable without removing said first flexible strand nor said second flexible strand from said slidable member.

* * * * *